US005124694A

United States Patent [19]

Dien

[11] Patent Number: 5,124,694

[45] Date of Patent: Jun. 23, 1992

[54] DISPLAY SYSTEM FOR CHINESE CHARACTERS

[76] Inventor: Ghing-Hsin Dien, 10F-A, No. 148, Sec. 2, Fu Hsing S. Rd., Taipei, Taiwan

[21] Appl. No.: 631,495

[22] Filed: Dec. 21, 1990

[51] Int. Cl.[5] ..... G05G 1/14

[52] U.S. Cl. ..... 340/750; 340/751; 340/735

[58] Field of Search ..... 340/750, 735, 781; 400/484, 109, 190, 147

[56] References Cited

U.S. PATENT DOCUMENTS 4,429,306 1/1984 Macauley et al. ..... 340/735

FOREIGN PATENT DOCUMENTS 0043639 3/1980 Japan ..... 340/751

*Primary Examiner*—Alvin E. Oberley
*Assistant Examiner*—Matthew Luu
*Attorney, Agent, or Firm*—Bacon & Thomas

[57] ABSTRACT

A system for displaying Chinese character by use of a hardware circuit is completely compatible with the English text mode and can achieve the results of the Chinese-English mixed display without any software. The display speed of which is as fast as English and the memory occupied remains the same with no needs to be increased. Besides, there is an advantage that it will not share the processing time of the central processing unit (CPU) while displaying Chinese.

2 Claims, 2 Drawing Sheets

DISPLAY SYSTEM FOR CHINESE CHARACTERS

BACKGROUND OF INVENTION

The present invention relates to a display system for Chinese characters in particular to a system for displaying Chinese characters by using a hardware circuit.

In the conventional computers, most of the display of Chinese characters is by using a Chinese character software stored previously in the computer or the disc driver. When character code to be displayed is input, the Chinese character software identifies the character to be displayed being Chinese or English and then gets the pattern for said character. Thereafter, the pattern for said character is sent to the video RAM and displayed onto the screen by using a graphic method, that is, the Chinese character 'graph' being plotted on the screen while in the graphic mode. A block diagram of the conventional Chinese display system is shown as follows:

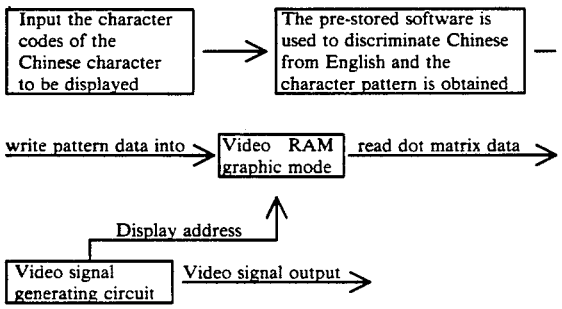

However, conventionally, English is generally displayed in the text mode, that is, the English character code (generally the ASCII code) is memorized into the video RAM and then the display of said character is completed by locating the pattern for said character code from the CGROM directly in dependent on the character code in the video RAM by the hardware followed by displaying the pattern onto the screen. The procedure from the character code through the pattern converted and then to display is completed by a hardware circuit. The block diagrams of the conventional English display system are shown as follows:

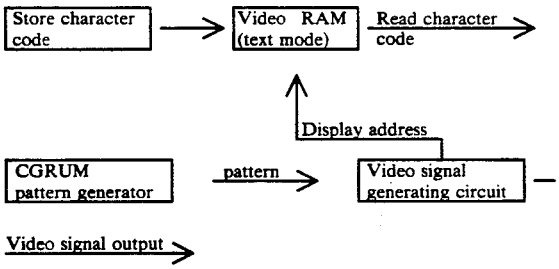

From the above description, we can see that in the conventional Chinese character display, there must be a software support during the display procedure from the character code to the Chinese character pattern converted. The text mode wherein the Chinese pattern can be directly displayed from the Chinese character code memorized into the video RAM cannot be attained. In other words, the conventional Chinese character display system is not compatible with the hardware under the text mode (i.e., without the support from the software). Therefore, the conventional Chinese character display is not compatible with the English display in the text mode so that some English software developed by the English language countries while applying to the Chinese characters have to be modified to add-in a driver or the software programs in order to display the Chinese characters.

Besides, the software processing is a must in the conventional Chinese character display. For that reason the Chinese display is absolutely slower than the hardware display in the text mode.

In addition, in the conventional Chinese character display method much more memory space is occupied, For example, e.g., only 2K byte of the video RAM is needed to display a screen of 80×25 under the English text mode. However, due to the graphic mode used in the conventional Chinese character display, in the case of a Chinese character display of 16×15, a screen of 80×25 (40×25 in Chinese) needs 32K byte of the video RAM. Also, some space of the system main memory will be occupied by the software program for processing the display of the Chinese characters.

Furthermore, owing to the software processing is a must for the conventional Chinese character display, the CPU of the system will spend some time on processing the video interface and make the speed of the whole system slow down.

Recently, though a Chinese pattern ROM is commercially available which can store more than ten thousands of Chinese characters by use of a hardware circuit, said Chinese pattern ROM cannot identify whether the code is an English character or a Chinese character such that the effects of mix using the English and the Chinese still cannot be obtained. Therefore, the software processing manner is still adopted in the display of Chinese characters.

SUMMARY OF THE INVENTION

In view of the afore-mentioned disadvantages of the conventional Chinese character display system, the present invention is directed to provide a Chinese character video display system by which the above said disadvantages can be improved. In the Chinese character display system according to the invention, the display of a Chinese character is in that by employing hardware circuit to read the next character code to be displayed beforehand and combine it with the current character code to be displayed and whether it is a Chinese character code can be decided. If it is a Chinese character, the display position of these two character codes will be displayed as a Chinese character. If not, the first character code is displayed as an English character and the second character code is kept until the next character code, i.e., the third character code is read. Again, the second and the third character codes are combined to be decided that whether it is a Chinese character code or not. Again, if it is a Chinese character code, the display position of these two character codes will be displayed as a Chinese character. Accordingly, the object of displaying both the Chinese and English is attainable. Further, the Chinese character code can be displayed without regarding to whether it appears on an odd address or an even address. The Original feature for displaying English characters will not be affected.

Therefore, according to an object of the invention, the Chinese character video display system according to the present invention which is compatible with the English display in the text mode can display the Chinese character while applying some sorts of English software developed by English language countries with no need to be modified or add-in a driver or a software driving program in order to display Chinese characters.

According to another object of the invention, the Chinese character display system of the invention which can directly display a Chinese character without a software processing has a faster display speed than the conventional Chinese display systems with a software support.

According to a still further object of the invention, the Chinese character display system of the invention which does not display through a graphic mode and with no need of a software support it will not occupy space from the main memory of the system, will occupy some smaller space of the memory.

According to still another object of the invention, the Chinese character display system of the invention which can display Chinese characters without being put through software processing and the CPU of the system thereof does not have to spend any time on processing the video interface, makes the processing speed of the whole system be much more faster than conventional Chinese display systems.

The present invention will become more readily apparent from the following description of the preferred embodiment of the present invention taken in conjunction with the accompanying drawings.

DETAILED DESCRIPTION OF PREFERRED EMBODIMENTS

Figure 1:
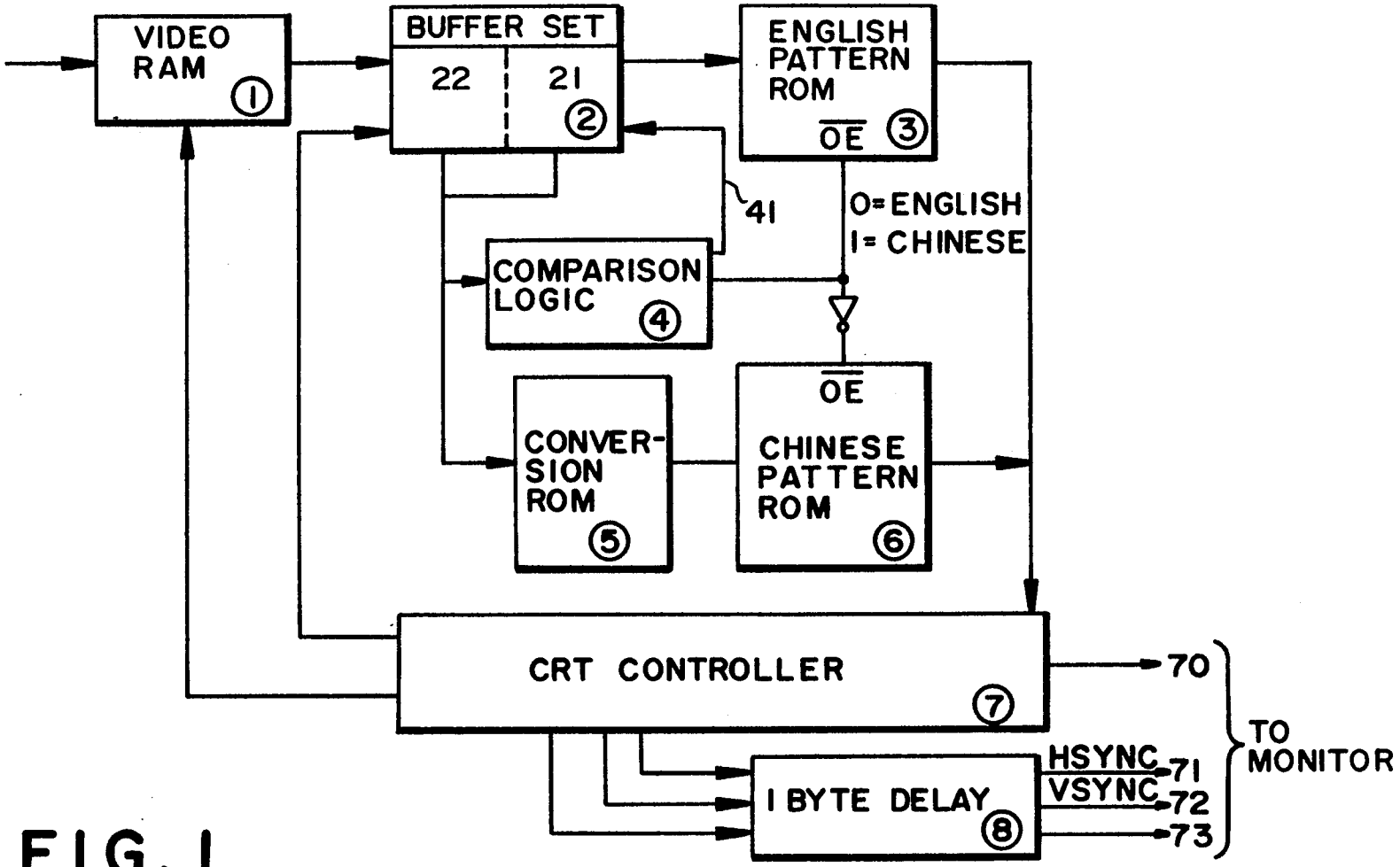
FIG. 1 is a block diagram of the system according to the present invention.
Figure 2:
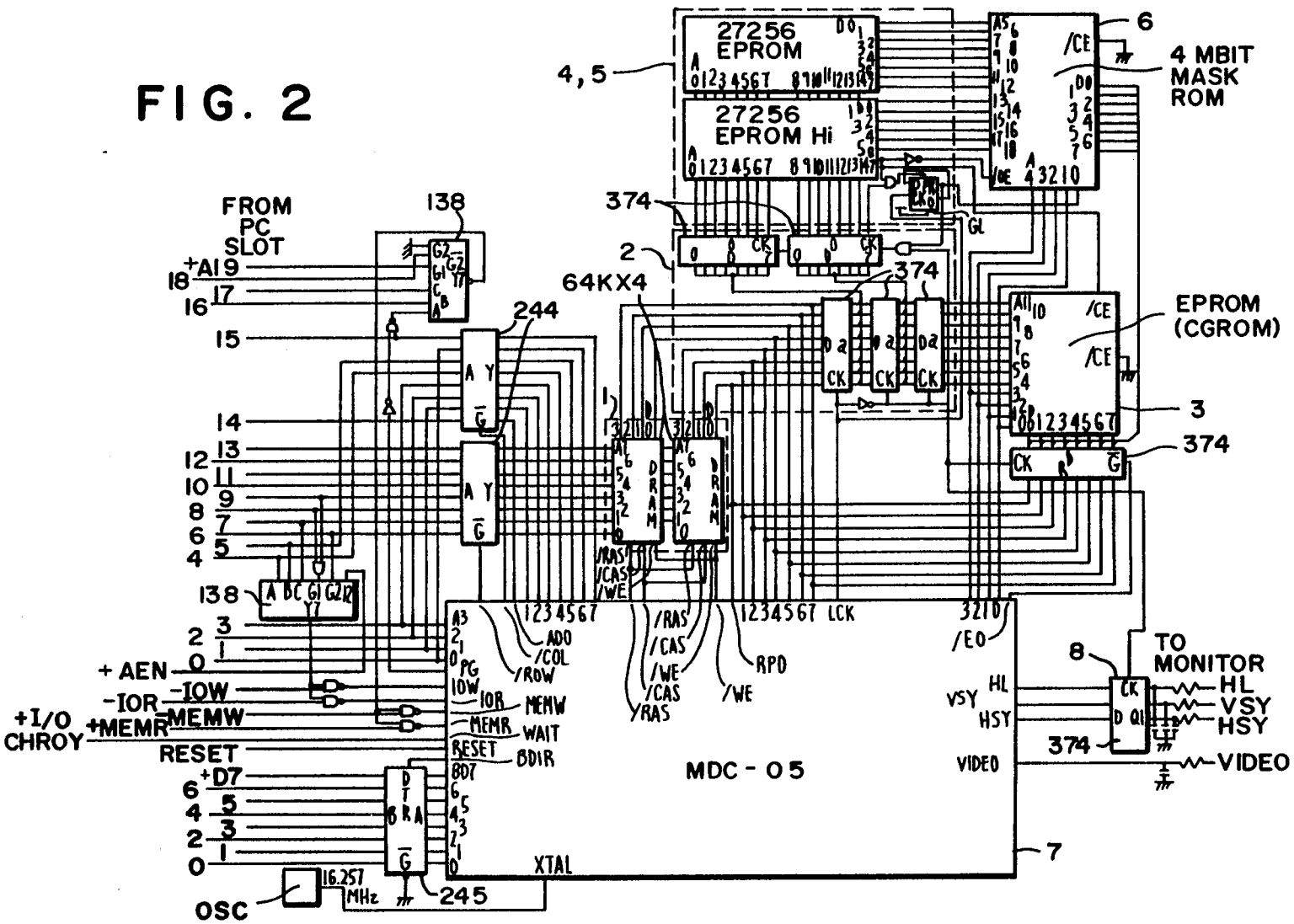
FIG. 2 is an illustrative diagram of the system according to the present invention.

As shown in FIG. 1 and FIG. 2, the Chinese characters display system of the invention comprises:

A video RAM 1 for storing the character code to be displayed by the CPU, and a CRT video signal generating control circuit reads the content of the video RAM one by one and displays the pattern of which at the corresponding address on the screen.

A buffer set 2 connects with the video RAM 1. For the purpose herein, the buffer set 2 provides a buffer of two bytes wherein one of which is the current character code displayed 21 and the other is the next character code to be displayed 22 in such a manner that one is a single character code output for displaying English and the other is a twin-character code output for displaying a Chinese character after it is identified as a Chinese character code by the Chinese-English selection logic.

An English character generator ROM 3 connects to an output terminal of the buffer set 2, which has the English character code as the input and outputs the pattern of said character code and the output enable thereof is controlled by a Chinese-English selection logic circuit 4 connected to an output terminal thereof. A selection logic circuit 4 is a comparison logic circuit used for identifying the twin-character code input is a Chinese character code or not and selecting a Chinese or English character pattern to be displayed according to the results of the comparison as well as generating a control signal 41 to control the operation of the buffer set 2.

Another output terminal of the buffer set 2 connects to a Chinese character-code/pattern-address conversion table 5 (ROM) which can generate the storage address of the Chinese character code input and in turn, locate said Chinese character pattern in the Chinese character memory corresponding to the said address.

The output enable (OE) terminal of the English character generator 3, an output terminal of the Chinese-English selection logic circuit 4, and the output terminal of the Chinese character-code/pattern-address convension table 5 connects to a memory 6 for storing Chinese character patterns which may be comprised of ROM or RAM and the output enable of which is controlled by the Chinese-English selection logic circuit 4.

The English character generator 3 and the Chinese character memory 6 all output to a video signal generating circuit (CRT) 7, which can generate the address signal required in reading the display memory and a code reading pulse, a horizontal sync signal, a vertical sync signal and other control signals, as well as convert the pattern data to a raster video signal to be output.

Because there is a time delay between reading the character code form the display memory 1 and getting the pattern data thereof, in order to synchronize each control signal 71, 72, 73 with the video signal 70, each control signal should be delayed by a delay circuit connected to the video generator 7 and then joint output with the video signal 70 to a monitor 9.

The Chinese character display system of the present invention is completely compatible with the English text mode and can achieve the Chinese-English mix display without any software such that the display speed is absolutely as fast as the English display and the memory occupied is the same as in the English display. In addition, it has an advantage of not spending any time of CPU while displays Chinese. In view of the above description, the Chinese character display system of the invention really can find its application in the field of the art.

I claim:

1. A Chinese characters display system comprising:

a video RAM for storing the character code to be displayed by the CPU and the contents thereof read one by one by a CRT video signal generating control circuit and the pattern thereof displayed at the corresponding address on the screen;

a buffer connecting with the video RAM for registering bytes which correspond to character codes;

an English character generator ROM connecting to an output terminal of said buffer, which uses the English character code as the input and outputs the pattern of said character code;

a logic circuit being a comparison logic circuit and connecting to the output terminal of said buffer, which can identify whether a two-character code input is a Chinese character code or not and select a Chinese or English character pattern to be displayed according to the results of the comparison as well as generates a control signal to control the operation of the buffer;

a Chinese character-code/pattern-address conversion table (ROM) connecting to another output terminal of the buffer, which generates the pattern address of the Chinese character code input and locates said Chinese character pattern corresponding to said address in the Chinese character memory;

a Chinese character storage memory consisted of RAM or ROM being connected to an output enable terminal of the English character generator, an output terminal of the Chinese-English selection logic circuit, and an output terminal of the Chinese character-code/pattern-address conversion table respectively;

a video signal generator circuit being connected to the output terminal of each of the English character generator and the Chinese character memory, which can generate an address signal required in reading the display memory and a code reading pulse, a horizontal sync signal, a vertical sync signal and other control signals and also convert the pattern data to a raster video signal to be output; and a delay circuit being connected to the video generator, which may delay the control signal to have it synchronize with the video signal and then mixed output to a monitor.

2. A Chinese character display system as claimed in claim 1, characterized in that: the buffer provides a buffer of two bytes wherein one of which is the current character code displayed and the other is the next character code to be displayed in such a manner that one is a single character code output for display in English and the other is a two-character code output for displaying a Chinese character after it is identified as a Chinese character code by the Chinese-English selection logic.

* * * * *